United States Patent [19]

Fricker et al.

[11] 4,364,339

[45] Dec. 21, 1982

[54] INTERNAL COMBUSTION ENGINE WITH COOLING SYSTEM

[75] Inventors: Ludwig Fricker, Stuttgart; Jörg Abthoff, Plüderhausen, both of Fed. Rep. of Germany

[73] Assignee: Daimler-Benz Aktiengesellschaft, Stuttgart, Fed. Rep. of Germany

[21] Appl. No.: 89,094

[22] Filed: Oct. 29, 1979

[30] Foreign Application Priority Data

Oct. 28, 1978 [DE] Fed. Rep. of Germany ..... 2847057

[51] Int. Cl.[3] ..... F01P 3/02

[52] U.S. Cl. ..... 123/41.42; 123/41.72; 123/41.82 R

[58] Field of Search ..... 123/41.02, 41.05, 41.08, 123/41.28, 41.35, 41.42, 41.72, 41.73, 41.74, 41.76, 41.82 R, 41.82 A, 41.85

[56] References Cited

U.S. PATENT DOCUMENTS

| | | | |
|---|---|---|---|
| 932,711 | 11/1909 | Knight et al. | 123/41.42 |
| 1,802,744 | 4/1931 | Wales | 123/41.42 |
| 2,788,773 | 4/1957 | Meurer | 123/41.35 |
| 3,063,435 | 11/1962 | Meurer et al. | 123/41.85 |
| 3,065,743 | 11/1962 | Brehm et al. | 123/41.35 |

FOREIGN PATENT DOCUMENTS

| | | | |
|---|---|---|---|
| 2524272 | 12/1976 | Fed. Rep. of Germany | 123/41.35 |
| 2649562 | 12/1977 | Fed. Rep. of Germany | 123/41.72 |

*Primary Examiner*—Craig R. Feinberg
*Assistant Examiner*—W. R. Wolfe
*Attorney, Agent, or Firm*—Paul M. Craig, Jr.

[57] ABSTRACT

A piston internal combustion engine with at least one cylinder and with a cooling system coordinated thereto that operates with a fluid medium and includes an oil-spray cooling system; at partial engine loads, the cooling output is reduced by disconnection of a part of the oil-spray cooling system so that the heat content in the combustion space increases while the specific fuel consumption is reduced and the warm-up period of the engine after the start is reduced.

4 Claims, 3 Drawing Figures

INTERNAL COMBUSTION ENGINE WITH COOLING SYSTEM

The present invention relates to an internal combustion engine with at least one cylinder and with a cooling system coordinated thereto that operates with a fluid medium, for example, with oil, air, or water.

The present-day customary piston internal combustion engine is cooled as a rule either by the two media of air and oil or water and oil. Additionally, heat is carried off by way of the exhaust gases and by direct radiation or by convection from the surface of the internal combustion engine.

The cooling system of the internal combustion engine is so designed that at full load operation and with maximum possible attainable rotational speed, the heat-carrying capacity of the cooling medium is just barely sufficient to avoid overheating of the structural parts surrounding the combustion chamber. A rotational-speed-dependent matching of the cooling water or oil quantity is achieved by way of the rotational speed dependence of the water or oil pump. The same is also true for the cooling air fan of an air-cooled engine. In that connection in every case with a deteriorating heat removal, for example, at high ambient temperatures, an additional fan may be turned on or the rotational speed of the existing fan may be increased.

Additionally, the engine warm-up phase after the start, especially after the cold start, is shortened by way of a water or cooling air bypass circuit in that during the period of time after the cold start, only a portion of the cooling water or of the cooling air is still utilized for the engine cooling. Only if the operating temperature is reached in the bypass circulation, the large air or water circulation with the larger heat-absorption capacity opens automatically, controlled by a thermostat.

In many cases, however, the cooling system known heretofore is not adequate and cannot be matched closely enough to the respectively existing heat conditions to the desired extent.

It is therefore the aim of the present invention to increase the heat content in the combustion chamber, especially at partial load operation, so as to be matched to a better extent than heretofore to the heat conditions in the engine, and to improve therewith the effective degree of efficiency as well as reduce the specific fuel consumption. Additionally, the warm-up period of the engine is to be shortened and the harmful components in the exhaust gas are to be reduced.

The problem is solved according to the invention by such a construction of the cooling system that an oil-spray cooling system is incorporated into the cooling system and in that the cooling output is reduced at partial load operation of the engine by disconnecting a portion of the oil-spray cooling arrangement and therewith the heat content in the combustion space is increased, the specific fuel consumption is reduced as well as the warm-up period of the engine is shortened after the start, especially after the cold start. A cooling system according to the present invention which operates with a fluid, for example, with water or with oil, can be designed in practical construction and according to the invention in such a manner that the channels for the cooling medium in the cylinder head are arranged exclusively in the direct proximity of the exhaust channels and of the valve seats for the exhaust and inlet valves. A portion of the cooling ducts arranged in the cylinder head may thereby be connected with a cooling medium reservoir, in which is disposed a cooling medium with a lower coefficient of thermal conductivity than water, for example "Glysantin."

However, the cooling system can also be so constructed that the entire area of the cylinder head is cooled by the oil-spray cooling system, wherein the spray nozzles are arranged in such an orientation that they spray the cylinder head bottom especially within the area of the valve seats, the area of the exhaust channels, of the seat of the spark plug or of the injection nozzles and of the prechamber. Cooling ribs may thereby be arranged in the aforementioned areas for purposes of increasing the heat-transfer surfaces. For purposes of controlling the oil discharged from the cooling spray nozzles, a boundary wall may be arranged about the cylinder head, and discharge openings may be arranged within its confines, through which the sprayed-on cooling medium of oil can flow off downwardly into the oil pan through channels in the cylinder wall.

The cooling system according to the present invention, however, can also be so constructed that channels for the cooling medium, for example water, are arranged only in direct proximity of the cylinder head bottom, of the exhaust channel bottom part with the valve seat portion, of the spark plugs or of the injection nozzles for the fuel or of the prechamber seat, whereas the remaining parts which are not surrounded by the cooling channels, such as the inlet valve seat portion and the upper part of the exhaust channel are sprayed by cooling medium, preferably oil, discharged from nozzles onto these places.

For the cooling of the crankcase and of the cylinder sleeve surfaces, provision may be made that the crankcase is constructed completely without channels for the guidance of a cooling medium, and cooling is realized by oil spray nozzles which spray the cylinder walls that may be provided with cooling ribs.

Furthermore, the pistons may be sprayed with cooling oil from below by means of nozzles. For purposes of improving the cooling effect, the bottom sides of the piston crowns may receive a particular configuration, for example an annular channel may be provided, through which the oil is moved more rapidly as compared to the surface to be cooled so that, as a result thereof, the cooling effectiveness is also increased.

It is important with the cooling system according to the present invention that the nozzles for the spray-oil cooling system are adapted to be connected or disconnected individually or group-wise. It becomes possible thereby that, at partial load operation and during idling, a part of the cooling nozzles is disconnected and as a result thereof, the heat management of the engine is matched better to the necessary heat removal which in this case is required only to a lesser extent.

An additional cooler may be provided for the recooling of the cooling medium, for example, of oil, which is controllable thermostatically depending on the output requirement. For purposes of better distribution of the sprayable cooling oil, the portion of the spray-oil nozzles adapted to be turned off may be connected in parallel with the continuously operating lubricating oil circulation. Additionally, the load-dependent connection or disconnection of the cooling medium may be controllable by the engine vacuum pressure or directly by means of the engine load adjusting member, for example the throttle valve, by way of electromagnetically or pneumatically actuated valves.

In a cooling system controlled in dependence on a load in accordance with the present invention, at least a significant part of the cooling system of the engine is realized by spary-oil cooling whereby the present day customary through-flow cooling can still be used additionally in a reduced form. The advantage which results from the shifting or division of the cooling system partially to the spray-oil system is that the extent of heat removal can be varied discontinuously in that all spray nozzles or a part thereof can be connected or disconnected. The change of the cooling medium through-flow, dependent upon a rotational speed of the engine, remains preserved as with the present day cooling systems. The control of the cooling system according to the present invention is so designed that a partial load operations of the engine and during an idling of the engine, the heat removal is reduced by disconnection of a part of the oil spray nozzle so that the engine operates with an increased heat level and with an improved efficiency.

The higher heat content of the combustion gases and of the combustion chamber has the effect of improving the quality of the exhaust gases and the mechanical efficiency of the engine.

A further advantage of the system of the present invention resides in the fact that, as a result of the lacking or strongly reduced second cooling medium, the engine oil more rapidly reaches its operating temperature after a cold start of the engine. Even if the overall quantity of cooling medium and lubricating oil should increase as compared to the present day engine, nevertheless during a warming up of the engine, the largest portion of cooling oil quantity can be kept temperature-controlled outside of the double oil circulation system operating during this period so that considerably more heat passes over to the oil than with a conventionally cooled engine.

The engine is supplied during its warm-up phase by a partial oil circuit. With higher heat production, the cooling or lubricating oil is re-cooled by thermostatic control by way of an oil cooler acted upon by air. The part of the spray-oil nozzles which can be disengaged is connected in parallel with the lubricating circuit that operates continuously. The load dependent turning on or off operations may be controlled, for example, by the suction pressure of the engine through electromagnetically or pneumatically actuated valves. The larger quantity of pressure oil which is suddenly required when turning an oil-spray cooling nozzle may be produced in case of need by a spring-loaded pressure oil reservoir.

Other objects, features, and advantages of the present invention will become more apparent from the following description when taken in connection with the accompanying drawing which shows, for the purposes of illustration only, one embodiment in accordance with the present invention, and wherein.

Figure 1:
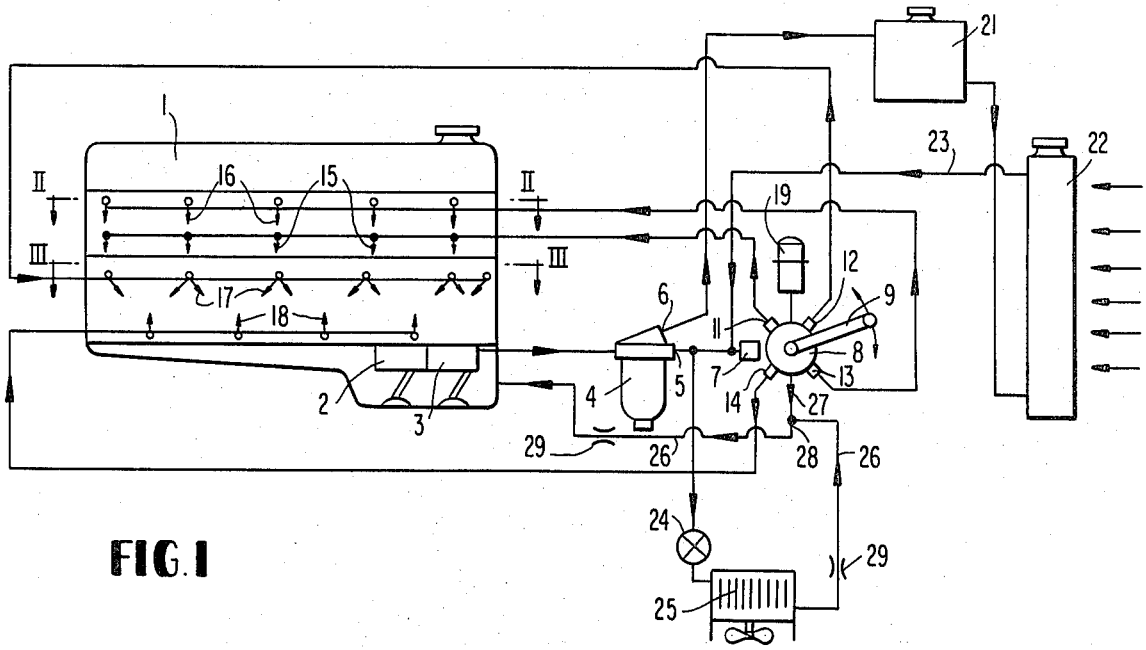
FIG. 1 is a schematic view of a cooling system controlled as a function of load in accordance with the present invention.
Figure 2:
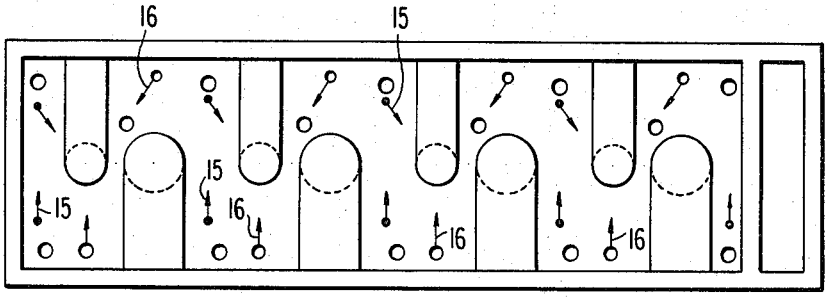
FIG. 2 is a schematic cross sectional view through the internal combustion engine taken along the line II—II of FIG. 1, with oil spray nozzles for cylinder head cooling.
Figure 3:
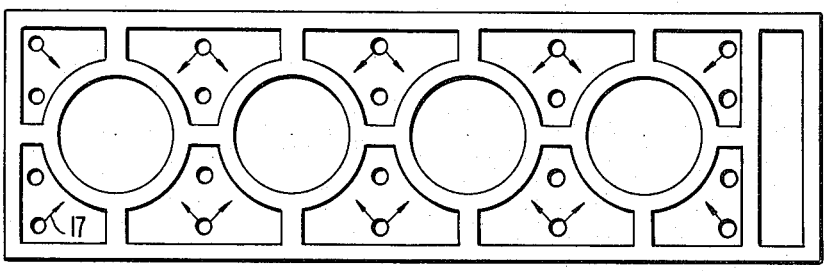
FIG. 3 is a schematic cross sectional view taken along the line III—III in FIG. 1, with oil spray nozzles for the oil cooling of a crankcase and cylinder liners of the engine.

Referring now to the drawing wherein like reference numerals are used throughout the several views to designate like parts, the arrows, in the various views, indicate the arrangement of the oil spray cooling nozzles and their spray direction. The solid circle tails of the arrows are intended to symbolically illustrate the oil spray cooling nozzles which are always turned on while the hollow circle tails of the arrows are symbolically represent the oil spray cooling nozzles which are adapted to be turned off.

The schematic drawing illustrated in FIG. 1 shows a piston internal combustion engine 1 with two oil pumps 2 and 3. The oil pump 2 is provided in the usual manner for the lubrication of the engine 1. A second oil pump 3 is provided for the oil spray cooling circulation. In addition to the oil pump 3, an oil filter 4 with thermostatically controlled outlet openings 5 and 6 belongs to the oil circuit or circulation system for spray cooling. If the cooling oil has reached a predetermined temperature threshold, the thermostatic valve in the oil filter 4 opens and a portion of the oil stream begins to flow through the external cooling system including the reservoir tank 21 and the vehicle radiator 22. With a full opening of the thermostatic valve, the entire cooling oil stream flows through the external cooling circuit or circulation system.

Additionally, a pressure maintaining valve 7 and a switching or shifting valve 8 are disposed in the oil spray cooling circulation. The shifting valve 8 supplies individual connections 12, 13, and 14 either sequentially or in unison with oil as a function of load by means of a lever 9.

The oil spray cooling nozzles are subdivided, for example, into four groups. The nozzles of the first group serve for the cooling of the cylinder head and are designated by the reference numeral 15. This first group is always turned on. It also supplies additionally the spray lubrication of the valve guidance and of the valve control. The second group of the oil spray cooling nozzles is designated by the reference numeral 16 and serves only for the cylinder head cooling and is turned on whenever the motor load and thus the heat to be removed has exceeded a predetermined value. The third nozzle group designated by the reference numeral 17 is also turned on at higher loads of the engine. It serves for crankcase cooling and for the cooling of the cylinder jackets. The fourth group of the oil spray cooling nozzles is designated by the reference numeral 18. It serves for the piston cooling and is also turned on whenever the engine load or the temperature of the engine have exceeded predetermined values. The nozzle groups 15 to 18 of the oil spray cooling nozzles are connected to the connections 11 to 14 of the switching or shifting valve 8. Dependent on the engine design, the turning on of the nozzle groups 12, 13, and 14 takes place sequentially individually or also in unison with an increasing load.

The oil spray nozzles are conceived as spring-loaded valves with a fixed spray-off pressure which can be adjusted approximately between 1 to 1.5 bar excess pressure. An spring-loaded oil pressure reservoir 19 and the pressure maintaining valve 7 cooperating therewith take care of the necessary operating pressure which is kept at about 1.5 bar. As a result thereof, with the engagement of a nozzle group by the switching or shifting valve 8, the spray operation may commence immediately.

Warm oil is fed by way of an oil reservoir 21 to an oil cooler 22, from which the oil is again returned into the oil circuit or circulation system by way of the line 23.

A heat exchanger 25 for the vehicle heating system is series-connected downstream of the oil filter 4 by way of a heating control valve 24. Throttle valves 29 are installed into the return line 26, in which also terminates the return line 27 from the switching or shifting valve 8, on both sides of the junction 28.

We claim:

1. A piston internal combustion engine with at least one cylinder means, a combustion chamber, a cooling system which operates with a cooling medium, the cooling system being coordinated to the cylinder means, and a continuously operating lubricating oil circulation system, characterized in that the cooling system includes an oil spray cooling means, means are provided for disconnecting a portion of the oil spray cooling means during a partial load operation of the engine so as to reduce the cooling ouptut of the cooling system and thereby increase the heat content in the combustion chamber so that specific fuel consumption is rendered and a warm-up period of the engine after a start of the engine is reduced, the spray oil cooling means are operable to be selectively disconnected and reconnected, a portion of the oil spray cooling means operable to be disconnected is operatively connected in parallel with the continuously operating lubricating oil circulatory system, and in that the means for disconnecting the oil spray cooling means is a valve means actuatable by engine suction pressure as a function of a load of the engine.

2. A piston internal combustion engine with at least one cylinder means, a combustion chamber, a continuous lubricating oil circulation system, a cylinder head, exhaust and inlet valve means, exhaust channel means, and a cooling system coordinated to the cylinder means including cooling channel means provided in the cylinder head for distributing the cooling medium, characterized in that the cooling system includes an oil spray cooling means, means are provided for disconnecting a portion of the oil spray cooling means during a partial load operation of the engine so as to reduce the cooling output of the cooling system and to thereby increase the heat content in the combustion chamber so that specific fuel consumption is reduced and a warm up period of the engine after restart of the engine is reduced, the cooling channel means are arranged essentially only in direct proximity of the exhaust channel means and of a valve seat means for the exhaust and inlet channel means, only oil spray cooling means are provided for cooling the cylinder head, the oil spray cooling means includes spray nozzle means directed so as to spray cooling oil into an area of a bottom of the cylinder head, the spray oil cooling means are operable to be selectively disconnected and reconnected, a portion of the oil spray cooling means operable to be disconnected is operatively connected in parallel with the continuously operating lubricating oil circulation system, and in that the means for disconnecting the oil spray cooling means is a valve means actuatable by engine suction pressure as a function of the load of the engine.

3. A piston internal combustion engine with at least one cylinder means including cylinder wall means, a combustion chamber, a continuously operating lubricating oil circulation system, a cylinder head, exhaust and inlet valve means, exhaust channel means, a cooling system which operates with a cooling medium, the cooling system being coordinated to the cylinder means and including cooling channel means provided in the cylinder head for distributing the cooling medium, and at least one spark plug means, injection nozzle means, and prechamber means, characterized in that the cooling system includes an oil spray cooling means, means are provided for disconnecting a portion of the oil spray cooling means during a partial load operation of the engine so as to reduce the cooling output of the cooling system and thereby increase the heat content in the combustion chamber so that specific fuel consumption is reduced and a warm-up period of the engine after a start of the engine is reduced, the cooling channel means are arranged essentially only in direct proximity of the exhaust channel means and of a valve seat means for the exhaust and inlet valve means, only oil spray cooling means are provided for cooling the cylinder head, the oil spray cooling means include spray nozzle means directed so as to spray cooling oil into an area of the bottom of the cylinder head within an area of the valve seat means, the exhaust channel means, and a seat means of at least one of the spark plug means, injection nozzle means, and prechamber means, a portion of the oil spray cooling means operable to be disconnected is operatively connected in parallel with the continuously operating lubricating oil circulatory system, and in that the disconnecting means for disconnection of the oil spray cooling means is a valve means actuatable by engine suction pressure as a function of a load of the engine.

4. A piston internal combustion engine according to claim 3, characterized in that said valve means is at least one of electromagnetically and pneumatically operated.

* * * * *